United States Patent [19]

Engelbart

[11] Patent Number: 4,591,139

[45] Date of Patent: May 27, 1986

[54] DEVICE FOR PICKING UP PLANAR WORK PIECES

[75] Inventor: Wilhelm Engelbart, Sylt-Ost, Fed. Rep. of Germany

[73] Assignee: Maschinenfabrik Herbert Meyer KG, Munich, Fed. Rep. of Germany

[21] Appl. No.: 657,527

[22] Filed: Oct. 4, 1984

[30] Foreign Application Priority Data

Oct. 6, 1983 [DE] Fed. Rep. of Germany ..... 3336426

[51] Int. Cl.[4] ..... B65H 3/20; B65H 1/04

[52] U.S. Cl. ..... 271/9; 271/10; 271/33; 271/145; 271/901; 112/121.12

[58] Field of Search ..... 271/10, 14, 33, 84, 271/171, 9, 901; 112/121.15, 121.11, 121.12, 320, 262.3

[56] References Cited

U.S. PATENT DOCUMENTS

| | | | |
|---|---|---|---|
| 3,083,961 | 4/1963 | Arbter | 271/33 |
| 3,945,632 | 3/1976 | Gray | 112/121.12 X |
| 4,143,871 | 3/1979 | Blessing | 112/121.12 X |

FOREIGN PATENT DOCUMENTS

| | | | |
|---|---|---|---|
| 0144030 | 8/1983 | Japan | 271/33 |
| 0961371 | 6/1974 | United Kingdom | 271/33 |

*Primary Examiner*—Bruce H. Stoner, Jr.
*Assistant Examiner*—Lawrence J. Goffney, Jr.
*Attorney, Agent, or Firm*—Kenyon & Kenyon

[57] ABSTRACT

An apparatus for picking up, transporting and exactly depositing planar work pieces, particularly cloth parts, comprises lifting devices which can be moved over work piece deposition points. The lifting devices comprise a pressure plate having a plurality of adhesive-tape pickups removably fixed thereon, e.g., by adhesion magnets. The adhesive-tape pick ups can be easily moved to any number of selectable points on the pressure plate in order to conform to the work piece to be picked up. The adhesive-tape pickups comprise a tubular housing having disposed therein a longitudinally movable adhesive-tape winding device with associated table deflection rolls. The tubular member has a baffle plate located at the bottom thereof. The baffle plate is provided with apertures. The tape deflection rollers protrude slightly through these apertures presenting adhesive tape for picking up a work piece when the apparatus is positioned at a pickup point. When the apparatus is positioned at a workpiece deposition point, lowering of the pressure plate at the deposition point causes the tape deflection rollers to be retracted within the apertures and work piece is stripped off by the baffle plate.

13 Claims, 14 Drawing Figures

DEVICE FOR PICKING UP PLANAR WORK PIECES

FIELD OF THE INVENTION

This invention relates to a device for picking up, transporting, and exactly depositing planar work pieces, particularly cloth parts, from at least one first deposition point to a second deposition point. Such a device comprises a running or rotary platform which bridges the deposition points and is equipped with at least one lifting means. The lifting means comprises pickups in the form of an adhesive-tape pickup arrangement which operates according to the adhesive effect principle. The adhesive-tape pickup arrangement comprising an adhesive tape winding device which can be moved lengthwise in the frame of the pickup in a guide mounting. Adhesive tape deflection rolls are located at the bottom of the frame for providing an adhesive surface. The frame bottom is formed with suitable openings for the passage of adhesive tape in the vicinity of tape deflection rolls in the pickup-shift position of the adhesive-tape winding device and the frame bottom also serves as a stripping baffle. Controlled up-and-down movement of the adhesive-tape winding device in the frame is carried out as a function of the motion of the lifting device, taking into consideration the step-wise continuing transport of the adhesive tape, in such a manner that the adhesive-tape winding device grips a work piece to be transported upon lowering the lifting device at the location of a first deposition point, holds the work piece during the transport to a second deposition point when lifting device is in a raised position, and releases the work piece after the lifting device is lowered at the location of the second deposition point.

BACKGROUND OF THE INVENTION

Devices of this type are disclosed in U.S. Pat. No. 3,083,961 and are used for partially automating processes in the apparel manufacturing industry. In the apparel manufacturing industry, automation is very important because this industry is still very wage-intensive as compared to other manufacturing industries. Automation is indispensable in view of the increasing cost pressure.

As is explained in the literature reference "Bekleidung-und-Maschenware" 22 (1983) No. 1, pages 6 to 11, considerable difficulties arise in restacking cloth parts, lifting such cloth planar work pieces perfectly from a work piece stack, and redepositing them in a stack at a prescribed position for further processing. If pneumatic pickup devices are used, only planar textile work pieces having a sufficiently small air permeability can be picked up and transported properly. Preferred prior art pickup devices operate according to mechanical principles using gripping systems which are equipped with pickup needles or clamping devices. However, as practice shows, such gripping systems have relatively low reliability and cannot be adapted optimally in every case to the greatly differing material properties of such planar work pieces.

Prior art pickups operating according to adhesive operating principles also have problems. Here, different material properties of work pieces do not play a large role. However, the adhesive force declines with use and in addition the adhesive surfaces become dirty. For this reason, as a practical matter, adhesive tape pickup arrangements can be only used wherein the apparatus includes adhesive-tape winding devices so that the adhesion surfaces can be continuously renewed during the course of the operating processes. The adhesive-tape pickup arrangement disclosed in U.S. Pat. No. 3,083,961 shows that such a pickup is a relatively bulky and complicated structure which permits practically no adaptation to work pieces having different dimensions. In the industry of apparel manufacture, however, great flexibility is demanded in such pickup devices because the cloth work pieces can differ very greatly as to size and also as to the dimensions.

OBJECTS OF THE INVENTION

It is therefore an object of the present invention to provide an adhesive-tape pickup arrangement which exhibits great adaptation flexibility to planar work pieces of practically any shape, which has high operating reliability, and which operates in a relatively simple technical manner.

These and other objects of the present invention will become apparent from the following description and claims in conjunction with the drawings.

SUMMARY OF THE INVENTION

The present invention is based on the important insight that high adaptation flexibility of a pickup device to the shape of the work pieces to be picked up can be brought about in an extraordinarily advantageous manner by providing a pickup arrangement which is subdivided into several tubular pickups. Each of the several pickups represent an independent functional unit and each can be located, because of their independent functional properties, on a pressure plate representing a common base plate in practically any desired arrangement. The several individual tubular pickups barely interfere with each other due to their design and can therefore always be aligned with the shape of a thin planar work piece to be picked up.

In a particularly advantageous embodiment of the present invention, an adhesive pickup device is provided for the deposition of two planar work pieces which are to be joined to each other at the input or feed side of a fixing press. The input or feed of the fixing press is referred to as the second deposition point. On both sides of the second deposition point (the input of the fixing press) are located a first deposition point preferably in the shape of a magazine for stacking the work pieces to be processed. A running platform brides the three deposition points and a carriage is mounted for movement on the running platform. Two synchronously controlled lifting devices are arranged on the carriage, one behind the other, in the direction of travel of the carriage with the distance between the lifting devices corresponding to distance of the second deposition point to the first deposition point. For every operational movement of the carriage, a work piece is deposited at the second deposition point by one lifting device while at the same time a work piece is picked up by the other lifting device at one of the two first deposition points.

Advantageously, the two first deposition points are magazines which receive stacks of work pieces to be processed. The magazines are accessible from the top and the lateral boundaries of the magazines are defined by brush elements with bristles which are aligned laterally and slightly downward. Advantageously, these brush elements can be positioned for adaptation to the outer contour of a stack of work pieces by arranging the brush elements on a base plate of iron-containing metal, for instance, a steel plate at a freely selectable point by means of adhesion magnets fastened to the brush elements.

As extensive tests underlying the present invention have shown, the plurality of individual adhesive tape pickups arranged on the pressure plate of the lifting device in a manner corresponding to the external shape of the work pieces to be picked up are exceptionally well suited as to arrangement and number for a neat installation of the work pieces deposited in a stack if use is made of brush magazines with the dimensions hereinafter described. The reason for this, among other things, is that not only the adhesive tape pickups as to number and arrangement, but also the brush elements forming in their totality a brush magazine, can be adapted optimally as to number and location to the outer contour as well as the size of the area of the work pieces unified in a stack.

The advance of adhesive tape in the adhesive-tape winding devices integrated in the adhesive-tape pickups, necessary in the course of the operating cycle, is suitably accomplished during the motion of the adhesive-tape winding device within the tubular housing in the region between its pickup and its stripping-off travel position.

Since the adhesive tape is subjected to wear in the adhesive-tape winding device during operation and must be renewed from time to time, it is found to be advantageous to design the adhesive-tape winding device as an interchangeable unit which can be inserted onto a guided holder of the device. A removable lid of suitable dimensions for the tubular housing is provided to make the interior of the tubular housing accessible for this purpose.

In a particularly preferred embodiment of an adhesive-tape pickup, the guide holder of the adhesive-tape winding device is connected to the piston rod of a small compressed-air cylinder which is accommodated on the side of the pressure plate in the tubular housing and which is connected via electrically controlled air valves and air hoses to a compressed-air distributor arranged on the pressure plate. The control of the compressed-air cylinder takes place in desired synchronism with the motion cycle of the lifting device. Using a compressed-air cylinder as the shifting drive for the adhesive-tape winding device has the advantage of particularly simple assembly in the manufacture of such pickups. Such a compressed-air cylinder further makes it possible to adjust the pressure of the adhesive tape onto the planar work piece to be lifted over wide limits, so that the adhesion required for the most varied materials of such work pieces can be adjusted as desired. Such a compressed-air cylinder further makes it possible to adjust the stroke within relatively wide limits.

In order to assure in such an adhesive-tape pickup working with a compressed-air cylinder any desired arrangement about the pressure plate while keeping connecting hoses as short as possible, the compressed-air distributor is advantageously a distributor strip which extends at its edge over the width and/or length of the pressure plate with a multiplicity of fast-contact cut-offs for the air hoses to be connected to.

BRIEF DESCRIPTION OF THE DRAWINGS

In the drawings forming part hereof, where like reference numerals indicate like parts.

DETAILED DESCRIPTION

Figure 1:
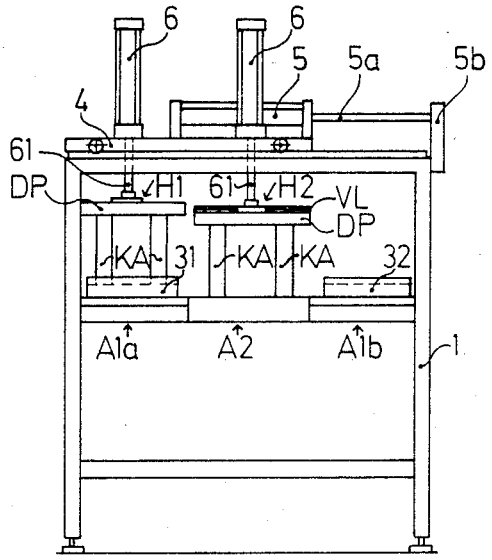
FIG. 1 is a schematic illustration of a device for the automatic deposition of cloth parts, intended to be fixed to each other, on the input side of a fixing press with such device illustrated in a first pickup and deposition location.
Figure 2:
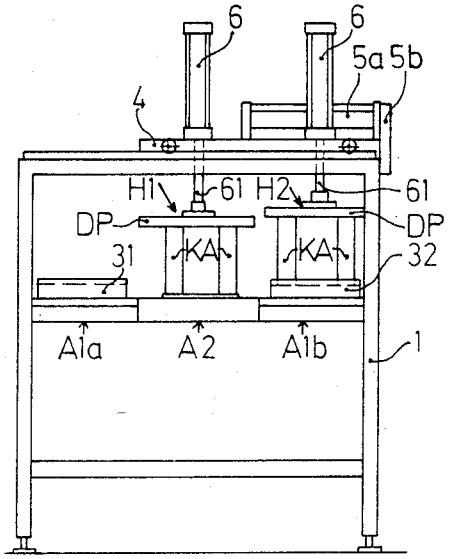
FIG. 2 schematically illustrates the device of FIG. 1 in a second pickup and deposition location.

FIGS. 1 and 2 illustrate an adhesive-tape pickup apparatus for the input side of a fixing press comprising a frame-like platform 1 which bridges three deposition points arranged side by side. The deposition point in the middle, which in the illustrated embodiment is second deposition point A2, serves to supply the work pieces to be fixed to each other in the fixing press to a feed, for instance, in the form of a conveyer belt. To the right and left of this second deposition point A2, are arranged first deposition points A1*a* and A1*b* which in this embodiment are magazines 31 and 32 which hold stacks of work pieces. A carriage 4 is mounted for movement on the top side of the platform. Carriage 4 is moved over the deposition points with a back and forth movement provided by a compressed-air cylinder 5 fastened to the carriage. A piston valve rod 5*a* of this compressed-air cylinder 5 is fastened with its free end to the holder 5*b* at the right hand top side of the platform 1. Two lifting devices H1 and H2 are mounted one behind the other on the carriage at a distance corresponding to the distance of the second deposition point A2 from the first deposition points A1*a* and A1*b*. Lifting devices H1 and H2 each comprise a pressure plate DP which is fastened at its top side to a piston rod 61 of a vertically aligned compressed-air cylinder 6. Each lifting device has on its underside several individual adhesive tape pickups KA which are fixed via fastening means, preferably adhesion magnets, at any desired point of the pressure plate. The fastening means can also be fast-action shut-offs or snaps which engage one of the numerous openings of the pressure plate provided with a hole raster. A pressure plate with a hole raster also makes it possible to fasten the adhesive-tape pickups KA by means of screws.

The compressed-air cylinders 5 and 6 are pneumatic drives which are conventionally controlled by electrically controlled valves, not shown in detail. In the embodiment according to FIG. 1, the carriage 4 is illustrated in the left end position and the lifting devices H1 and H2 have executed a downward stroke. In this position, the adhesive-tape pickups KA of the lifting device H1 lift a work piece, for instance, a cloth part, off the stack of work pieces in the magazine 31 at the first deposition point A1*a*, while the lifting device H2, assuming the start of the operation, does not yet execute a deposition function.

In the next operating step, the pressure plates DP of the two lifting devices H1 and H2 execute an upward stroke and are moved by the carriage 4, via the compressed-air cylinder 5, into the right end position as is illustrated in FIG. 2. During the subsequent lowering of the pressure plates DP, the cloth part picked up from the first deposition point A1*a* is deposited at the second deposition point A2 and at the same time, a work piece, for instance, a fixation insert, is picked up by the adhesive-tape pickups KA of the lifting device H2 from the work piece stack in the magazine 32 at the first deposition point A1*b*. After the pressure plates DP of the two lifting devices H1 and H2 are shifted by the carriage 4 by means of the compressed-air cylinder 5 into the left end position shown in FIG. 1, the lifting devices H1 and H2 are again lowered and the fixation insert which sticks to the free ends of the adhesive-tape pickups KA of the lifting device H2 during transport is deposited exactly over the previously deposited cloth part at the second deposition point A2. At the same time, the adhesive-tape pickups KA of the lifting device H1 pick up a work piece from the work piece stack in the magazine 31. Accordingly, for every movement of the carriage 4 and a lifting motion of the two lifting devices H1 and H2, a work piece is simultaneously picked up at a first deposition point and is deposited at the second deposition point. As soon as the two work pieces to be fixed to each other have been deposited at the second deposition point A2, the conveyer belt of the second deposition point A2 is set in motion and transports the cloth parts to be fixed to each other into a press (not illustrated).

As will be hereinafter discussed, a preferred embodiment for the shifting motion of the adhesive-tape winding device provided in an adhesive-tape pickup comprises a compressed-air cylinder which is actuated in the same manner as the compressed-air cylinders 5 and 6, that is, via electrically controlled valves and is connected via tubing to a compressed-air distributor. For a freely selectable arrangement of such a plurality of adhesive-tape pickups KA over the area of the pressure plate DP with relatively short hoses, a compressed-air distributor in the form of a distributor strip VL extending at the edge and over the width and/or length of the pressure plate is provided and which is illustrated on lifting device H2 of FIG. 1.

Figure 3:
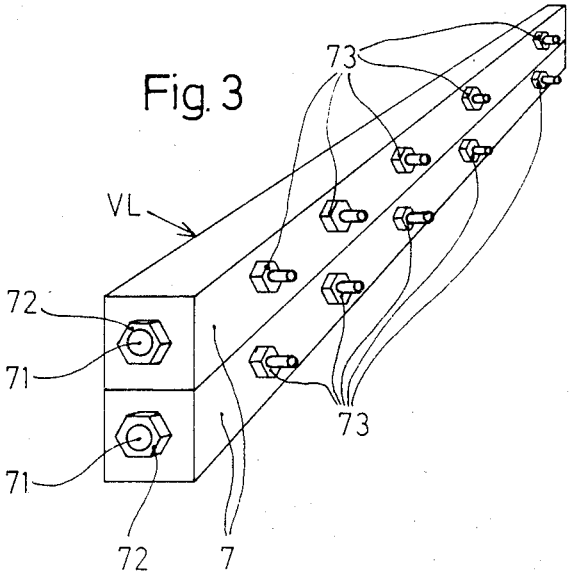
FIG. 3 is a schematic perspective view of a compressed-air distributor strip for connecting air hoses of adhesive-tape pickups controlled by compressed-air drives.

This distributor strip VL is illustrated in perspective in FIG. 3. Distributor strip VL comprises two metal bars 7 which lie on top of each other and have along their length an axial hole 71 with a screw connection 72 and furthermore have distributed over their length a number of fast-acting contact shut-offs 73 which are in communication with the axial hole in the metal bars 7.

Figure 4:
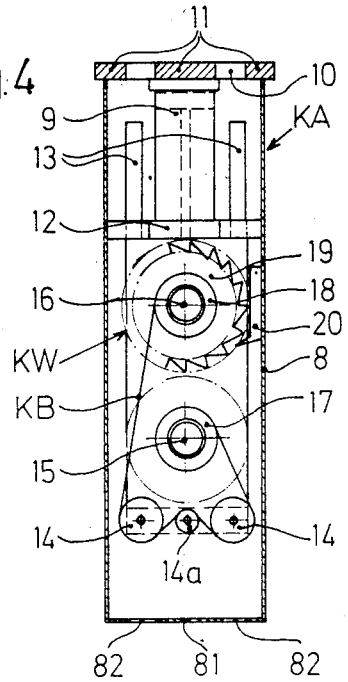
FIG. 4 is a schematic illustration of an adhesive-tape pickup operated with compressed air wherein the adhesive tape winding device is in the upper stripping-off shift position.
Figure 5:
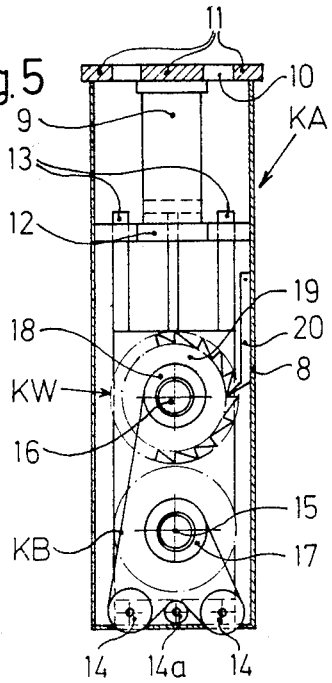
FIG. 5 schematically illustrates the adhesive-tape pickup of FIG. 4 wherein the adhesive-tape winding device is in the lower pickup shift position.

One embodiment of an adhesive-tape pickup KA is illustrated in cross section in FIGS. 4 and 5 and comprises a tubular housing 8 which is terminated on the top side by a plate 10 with a worked-in adhesion magnet 11 for mounting the adhesive-tape pickup KA on the pressure plate of the lifting device. A compressed-air cylinder is fastened on the side of the plate 10 on an intermediate plate 12. This compessed air cylinder 9 moves the adhesive-tape winding device KW from an upper stripping-off shift position as shown in FIG. 4, into a lower pickup shift position as is shown in FIG. 5. A guide holder 13 for the adhesive-tape winding device KW is guided by plate 12. The tubular housing 8 has mounted on its lower free end an end baffle plate 81 which is provided with openings 82 for the passage of the deflection rolls 14 which are provided on the underside of the adhesive-tape winding device and represent adhesion rolls. The adhesive-tape winding device KW further comprises, in addition to a further smaller deflection roll 14*a* arranged between the deflection rolls 14, an unwinding reel 17 and an adhesive tape winding-up reel 18 rotatably supported one above the other in journals 15 and 16. Rigidly connected to the adhesive-tape winding-up reel 18 is a gear 19 which is also rotatable on the journal 16 and which meshes in the manner of a ratchet with a drive 20 fastened to the tubular housing 8. In the event of a shifting motion of the adhesive-tape winding device KW from its lower pickup shifting position into its upper stripping-off shifting position 20, gear 19 rotates through a rotation-angle range determined by the teeth of the gear 19. In this manner, after the stripping off a work piece by raising the winding device KW, the adhesion areas of the adhesive-tape KB are transported a small distance on the deflection rolls 14 which previously had been in contact with the work piece during the pickup and during the transport of the work piece from a first deposition point to the second deposition point. Therefore, in the subsequent pickup and deposition processes, fresh adhesive tape KB is made available again and again for picking up work pieces.

Making further reference to FIGS. 1 and 2, the shifting motion of the adhesive-tape winding device KW takes place by means of the compressed-air cylinder 9 operating in synchronism with the lifting motion of the lifting devices H1 and H2 in such a manner that, for instance, during the lowering of the lifting device H1 illustrated in FIG. 1, the adhesive-tape winding device, for picking up a work piece from the work piece stack in the magazine 31 of the first deposition point A1*a*, is brought from its raised stripping-off shift position into its lower pickup shift position wherein the deflection rolls 14 with the adhesive tape KB protrude slightly through the openings 82 of the end baffle 81 and thereby are pressed against the work piece to be pickup up when the lifting device H1 completes the downward stroke. During the lifting of the lifting device H1, the adhesive-tape winding device KW remains in the lower pickup shift position until the lifting device H1 has arrived, as illustrated in FIG. 2, over the second deposition point A2 and has been lowered in a further downward stroke onto the second deposition point. Then, in the lowered lift position of the lifting device H1, a shift of the adhesive-tape winding device KW from its lower pickup shift position into its upper stripping-off shift position by compressed-air cylinder 9 takes place. As FIG. 5 illustrates, the rachet-like drive 20 now comes into engagement with the gear 19, and the before-mentioned transport of the adhesive tape KB takes place during the shift of the adhesive-tape winding device KW upward. At the same time, the end baffle 81 of the tubular housing 8 acts as a stripper for the work piece sticking to the adhesive tape KB in the region of the deflection rolls 14. By appropriately choosing the number of teeth of the gear 19, the travel length of the adhesive-tape KB can be fixed, which travel is performed during a shift of the adhesive-tape winding device KW upward.

Figure 6:
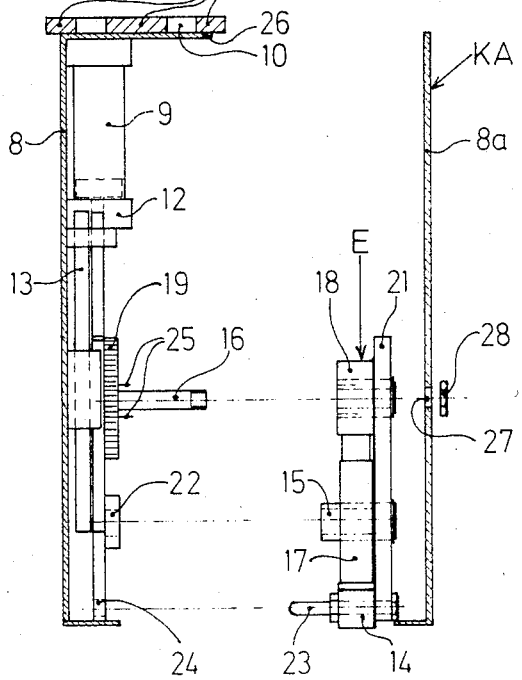
FIG. 6 is a schematic illustration of a variant of an adhesive-tape pickup of the type illustrated in FIGS. 4 and 5 showing an exploded view of an adhesive-tape winding device designed as an interchangeable unit.

The consumption of adhesive-tape KB during the course of the operation makes it necessary from time to time to replace a spent adhesive-tape reel with a new adhesive-tape reel. With reference to FIG. 6, in order to keep the relationships as simple as possible, it is advantageous to make the adhesive-tape winding device interchangeable in the form of a unit E which can be slipped onto the guide holder 13 which includes the gear 19 and the journal 16. The unit E comprises a carrier plate 21 on which the deflection rolls 14 and 14*a*, the adhesive-tape unwinding reel 17, and the adhesive-tape wind-up reel 18 are mounted in a predetermined position. The unit journal 15 for the adhesive-tape unwinding reel 17 is fastened to the carrier plate 21. Journal 15 has a counterbearing 22 mounted on the guide holder 13. The same applies for the tape deflection rolls 14 and 14*a*, which are rotatably supported on the journals 23. The counter-bearings for tape deflection roll journals are also mounted on guide holder 13 and are designated as 24 in FIG. 6. The gear 19 has positioned on both sides of the journal 16 driving pins 25 which engage correspondingly arranged recesses (not shown specifically in FIG. 6) of the adhesive-tape rewinding reel 18 when the unit E is slipped onto the guided holder 13.

As illustrated in FIG. 6, the tubular housing 8 is subdivided into a first housing part which is rigidly connected to the guide holder 13, and a removable lid 8*a*. When the unit E is installed on the guide holder 13, the upper end of lid 8*a* engages a slot 26 of the plate 10. The journal 16 further extends through the unit E and through an opening 27 in the lid 8*a* and makes possible, through a thread provided at the free end of journal 16, a screw connection of the lid 8*a* with the housing 8 via a threaded nut 28.

Figure 7:
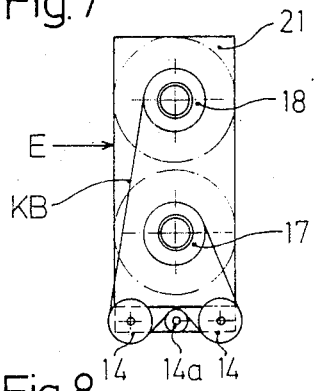
FIG. 7 illustrates a first embodiment of an adhesive-tape winding device designed as a unit.
Figure 8:
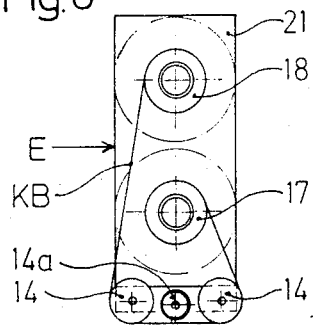
FIG. 8 illustrates a second embodiment of an adhesive-tape winding device designed as a unit.

FIGS. 7 and 8 illustrate two additional embodiments of adhesive-tape winding devices designed as interchangeable units E. The unit E illustrated in FIG. 7 corresponds to the embodiment shown in FIGS. 4 and 5 wherein a smaller deflection roll 14*a* is arranged in between two larger deflection rolls 14. In the pickup position, the smaller roll 14*a* is offset inward of the underside to the two larger rolls 14. In this process, an adhesive-tape point for picking up a work piece is obtained on the respective circumferences of deflection rolls 14.

The embodiment according to FIG. 8 is suitable especially if the planar work pieces to be picked up require a larger adhesion surface because of their own weight. This is accomplished by making the middle deflection roll 14*a* larger and the adhesive-tape KB is stretched in planar fashion between the deflection rolls 14. It will be appreciated that in the embodiment according to FIG. 8, the end metal plate 81 of the tubular housing 8 is provided with a single rectangular opening extending between the deflection rolls 14.

Figure 9:
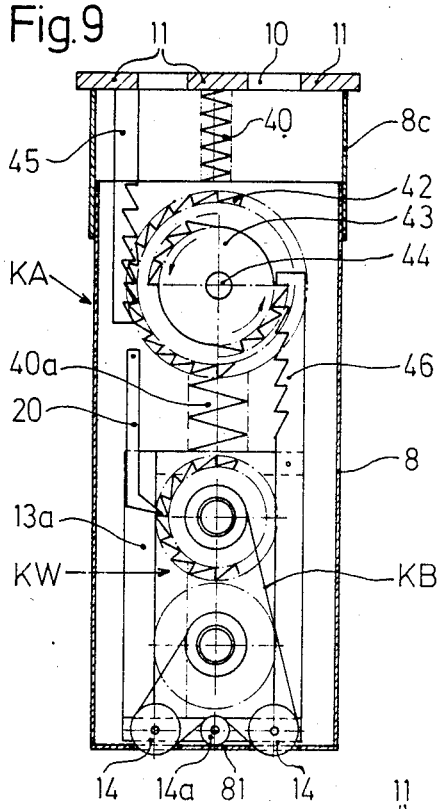
FIG. 9 schematically illustrates a first embodiment of an adhesive-tape pickup wherein displacement of the adhesive-tape winding device is actuated via a pressure hood in dependence on the lifting motion of the lifting device.
Figure 10:
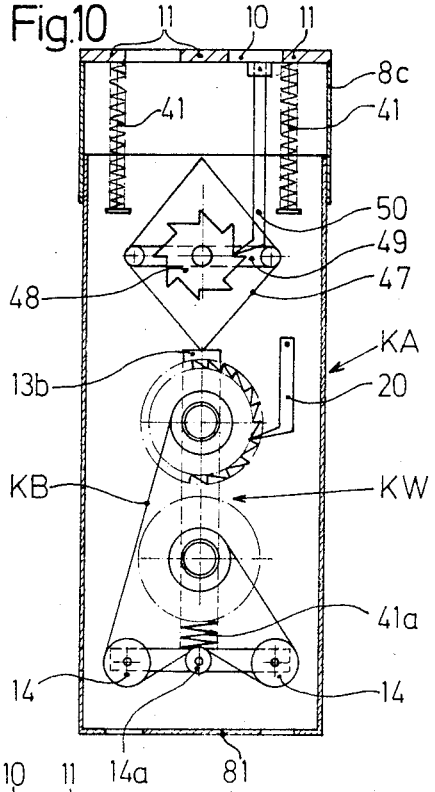
FIG. 10 schematically illustrates a second embodiment of an adhesive-tape pickup wherein the displacement of the adhesive-tape winding device is actuated via a pressure hood in dependence on the lifting motion of the lifting device.
Figure 11:
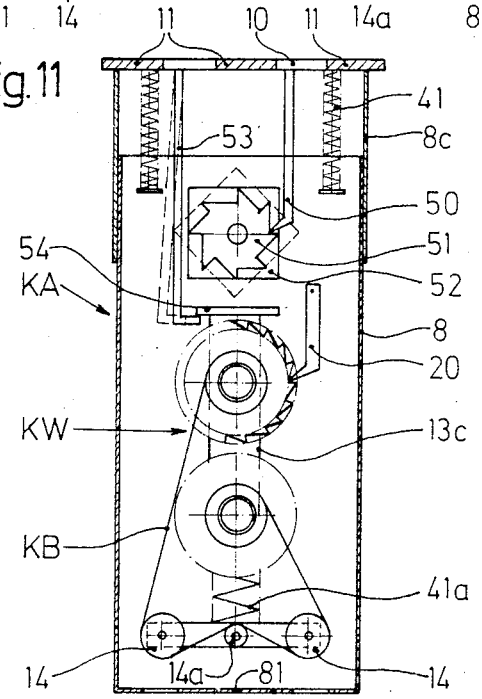
FIG. 11 schematically illustrates a third embodiment of an adhesive-tape pckup wherein an adhesive-tape winding device can be moved in dependence on the lifting motion of the lifting device.

Additional preferred embodiments of adhesive-tape pickups are illustrated in FIGS. 9, 10 and 11. These embodiments differ from the embodiments of an adhesive-tape pickup shown in FIGS. 4 and 5 in that they are terminated on the side of the pressure plate by a pressure hood 8*c*, in which the tubular housing 8 is held in the manner of a telescope and can be moved against the force of at least one spring element 40 or 41 in the direction toward the base 10 of the pressure hood 8*c*. The base of the pressure hood 8*c* is formed similar to the embodiment of FIGS. 4, 5 and 6, by a metal plate 10 with adhesion magnets 11 inserted therein. These three additional embodiments further differ from the embodiment according to FIGS. 4 and 5 by having guide holders 13*a*, 13*b* and 13*c* for the adhesive-tape winding device KW of somewhat different design. All have an additional spring element 40*a* and 41*a*. This spring element 40*a*, 41*a* acts in such a manner that the adhesive-tape winding device KW can be transferred via the guide holder 13*a*, 13*b* and 13*c*, respectively, into its upper stripping shift position from its lower pickup shift position and then again into its upper or raised stripping shift position. The adhesive tape KB is transported similar to the embodiments of FIGS. 4 and 5 during a shift of the adhesive-tape winding device KW from its lower pickup shift position into its upper stripping shift position accompanied by the engagement of a driver 20 fastened to the tubular housing 8 with a gear 19 which is rigidly connected to the adhesive-tape winding reel 18.

In the embodiment according to FIG. 9, the shifting motion of the adhesive-tape winding device is made possible via two gears 42 and 43 which are rigidly connected to each other and are rotatably supported above the guide holder 13*a* in a journal 44, and are designed in the manner of a ratchet. The gear 42 engages a rack 45 fastened to the base 10 of the pressure hood, while the gear 43 engages on the right with a rack 46 which is fastened to the guide holder 13*a*. In the gear 43, the gear rim is incomplete in that in successive 90° sectors, teeth and no teeth are alternately provided. This 90° sector division is determined only by the 90° angle of rotation which the two gears execute toward the end of a lowering motion of the lifting device.

In the embodiment according to FIG. 9, the adhesive-tape winding device KW is in its lower pickup shift position wherein a work piece sticking to the adhesive tape KB in the region of the deflection rolls 14 is transported from a first deposition point A1*a* or A1*b* to the second deposition point A2 as illustrated in FIGS. 1 and 2. When the lifting device H1 or H2 is lowered, the tubular housing 8 is pushed into the pressure hood 8*c* when the adhesive-tape pickup KA is on the second deposition point A2 and in the process the gears 42 and 43 are rotated 90° in the direction shown by the arrow via the rack 45. Since in this case the guide holder 13*a* is in engagement with the teeth of the gear 43 via the rack 46, the adhesive-tape winding device KW is simultaneously moved during this shifting motion of the tubular housing 8 from its lower pickup shift position into its upper stripping shift position. The adhesive-tape winding device KW now remains in this upper stripping shift position until the lifting device carriers out a lowering motion again at a first deposition point A1*a* or A1*b*. During the lowering operation, the housing 8 with its face baffle 81 braces itself on the work piece stack in the magazine 31 or 32 and the tubular housing 8 is again pushed into the pressure hood 8*c* and in the course of the further lowering of the lifting device, the engagement of the rack 46 with the gear 43 is detached by the rotation of the two gears 42 and 43 by the rack 45, and the adhesive-tape winding device KW slides in its guide holder 13*a* from its upper stripping shift position under the force of the spring element 40*a* into its lower pickup shift position for picking up a further work piece. At the end of the succeeding lowering motion of the lifting device over the second deposition point A2, the rack 46 comes into engagement with the teeth of the gear 43 via a further rotation of the two gears 42 and 43 and executes at this point the desired shift of the adhesive-tape winding device KW into its upper stripping shift position.

In the embodiment according to FIG. 10, the shifting of the adhesive-tape winding device KW is brought about as a function of the lifting motion of the lifting device by means of a cable pull 47, the cable length of which can be shortened in the direction of lifting the adhesive-tape winding device KW via a spreading device 49 controlled by a control wheel 48 in the form of a rotating bracket. In FIG. 10, the spreading device 49 is activated into the illustrated position by the control wheel 48 and the adhesive-tape winding device KW is shifted into its upper stripping shift position by the shortening of the cable pull 47. During lowering the lifting device on a first deposition point A1*a* and A1*b* as illustrated in FIG. 1, the control wheel 48 is advanced during the insertion of the tubular housing 8 into the pressure hood 8*c* via a push rod 50 fastened at the base 10 of the pressure hood 8*c* into the next switch position, in which the spreading device 49 is deactivated. Deactivation causes lengthening of the cable pull 47 and makes it possible for the adhesive-tape winding device KW to be transferred in its guide holder 13*b* under the power of the spring element 41*a* from its raised stripping shift position into its lower pickup shift position. During the next stroke into the pressure hood 8*c* in the course of the lowering motion of the lifting device onto the second deposition point A2, the control wheel 48 is advanced via the push rod 50 to a new activation of the spreading device 49 and in line with the desired stripping-off of the work piece, the adhesive-tape winding device KW is again transferred into its upper stripping shift position.

In the embodiment illustrated in FIG. 11, there is provided above the guide holder 13*c* for the adhesive-tape winding device KW, a ratchet release device 52 which can be controlled by a control wheel 51 and in which the control wheel 51 is again advanced, in accordance with the embodiment of FIG. 10, by a push rod 50 for a stroke of the pressure hood 8*c* relative to the tubular housing 8 in the manner of a ratchet. This operation makes it inoperative with every second stroke. A resilient detent finger 53 is fastened to the bottom of the pressure hood 8*c* opposite to a counter-detent 54 located on the top side of the guide holder 13 for the adhesive-tape winding device KW. In the position of the adhesive-tape winding device KW shown in FIG. 11, i.e., the upper stripping shift position, the detent between the detent finger 53 and the counter-detent 54 is operative. The detent finger 53 is detented into the counter-detent 54 during one stroke of the pressure hood 8*c* relative to the tubular housing 8 during a lowering motion of the lifting device at the second deposition point A2 shown in FIGS. 1 and 2. The guided holder 13*c* with the adhesive-tape winding device KW is held in the raised position during the course of an upward motion of the lifting device against the force of the spring element 41*a*. During the next stroke of the pressure hood 8*c* relative to the tubular housing 8 during the next lowering motion of the lifting device at a first deposition point A1*a* and A1*b*, respectively, the detent finger 53 is snapped out of the counter-detent 54, as illustrated in phantom, so that now the guide holder 13*c* with the adhesive-tape winding device KW is again lowered, by the force of the spring element 41*a*, into its lower pickup shifting position.

As extensive investigations underlying the invention have shown, a PVC tape with a thickness of 0.05 mm, a width of 12 mm, a density of 1.38/cm$^3$ and an adhesion of 225 ponds for a length of 25 mm at this width is particularly well suited as the adhesive tape KB for the adhesive-tape winding device KW. It is found that such an adhesive tape can readily be accommodated in a length of 30 m in the adhesive tape winding device KW, even taking the relatively small dimensions of the adhesive-tape pickup KA into consideration.

Figure 12:
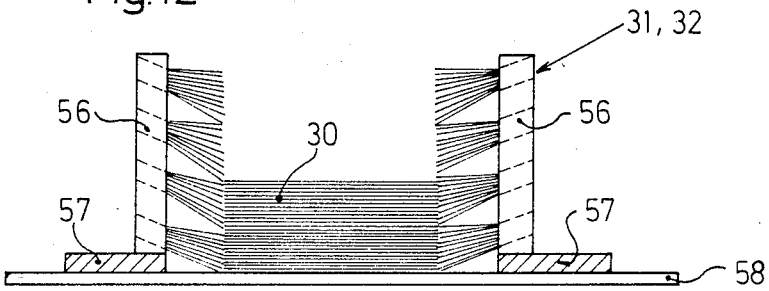
FIG. 12 schematically illustrates a brush magazine partially in cross-section.

As has already been pointed out, the proper operation of lifting devices equipped with pickups very largely depends on an operation wherein the planar work pieces stacked in magazines at the deposition points in the form of cloth parts, fixing parts and other textile structures can be separated without difficulty, i.e., they can readily be lifted off such a stack. FIG. 12 shows in a cross section such a magazine 31, 32 which makes such proper separation possible and which comprises brush elements 56 with bristles which face the work piece stack 30 and wherein the brush elements are preferably aligned at an angle of about 20° inclined downward. In order to match the brush elements 56 easily with the outer contour of such a work piece stack, they have adhesion magnets 57 on the base side, by means of which they can be set at any point of the magazine bottom which comprises, e.g., a steel plate 58. As practice has shown, the brush magazines 56 adavantageously comprise pig's bristles with a length of 20 mm and a thickness of 0.10 to 0.20 mm since such bristles possess highly flexible properties.

Figure 13:
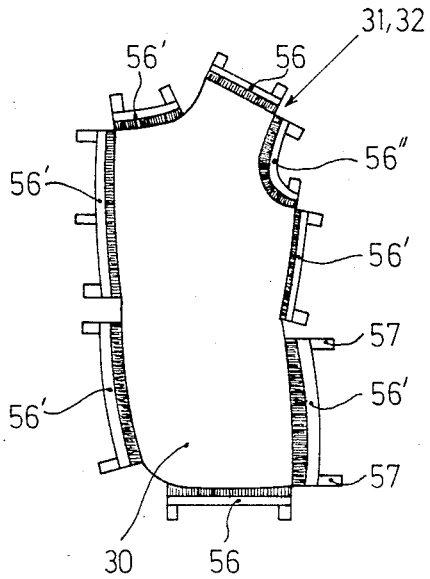
FIG. 13 schematically illustrates a top view of a brush magazine for the front parts of a lounging suit.

FIG. 13 shows in a top view a magazine 31/32 designed in this manner for a work piece stack 30 comprising the front parts for a lounging suit. The brush elements with the adhesion elements 57 on the base side can be arranged for good adaption to the outer contour of the lounging suit front part using straight brush elements 56, slightly curved brush elements 56' and heavily curved brush elements 56''.

Figure 14:
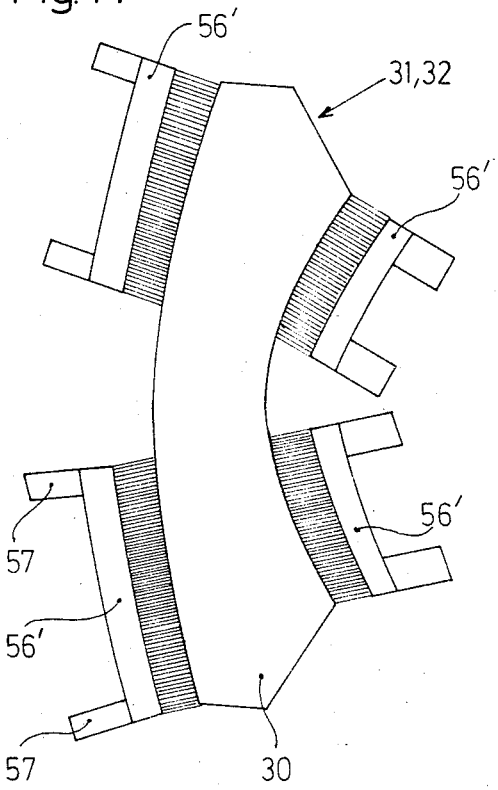
FIG. 14 is a schematic top view of a brush magazine for collar parts.

FIG. 14 shows a corresponding magazine 31, 32 for a work piece stack 30 comprising collar parts wherein four slightly curved brush elements 56' are sufficient.

The adhesion magnets 57 for the brush elements 56, 56', 56'' as well as the adhesion magnets for setting the adhesive-tape pickups KA at the pressure plate DP of a lifting device H1, H2 preferably are permanent adhesion magnets having extra-high adhesion force such as is exhibited by cobalt or also ceramic magnets. Advantageously, the width of the magnets is 10 to 12 mm, the length 46 to 50 mm, and the thickness 3 to 10 mm. The adhesive force is suitably between the limits of 18 and 26 kiloponds. Instead of the adhesion magnets 11 inserted into the metal plate 10, as illustrated in FIGS. 4 to 6 and 9 to 11, the adhesive-tape pickups can also have on their top side an entire magnetic plate with the dimensions $L \times B \times H = 50 \times 50 \times 5$ mm which is bolted to a metal substrate.

Although preferred embodiments of the present invention have been described in detail, it is contemplated that modifications may be made by one skilled in the art all within the spirit end the scope of the present invention which is defined in the claims.

What is claimed is:

1. In an apparatus for picking up, transporting and exactly depositing planar workpieces having a selected shape from at least one first to a second deposition point wherein said apparatus includes:

a platform disposed over and bridging said deposition points;

lifting device means movably mounted on said platform for horizontal movement between said deposition points and for vertical movement between a raised position and a lowered position;

adhesive tape pick up means mounted on said lifting device means comprising a vertically disposed frame member having an upper and lower end, a baffle member having an aperture therein disposed on the lower end of said frame member, an adhesive tape winding means having adhesive tape deflection roller means associated therewith for receiving adhesive tape from said winding means, with said winding means and said associated roller means movably mounted in said frame member for vertical movement in said frame between an upper operating position and a lower operating position wherein said roller means are arranged on said winding means facing said aperture of said baffle member and protrude through said aperture when said winding means is in said lower operating position and said roller means are retracted with respect to said aperture when said winding means is in said upper position;

means for lowering said lifting device and means for lowering said winding means to said lower position at said first deposition point whereby said roller means protrude through said aperture and adhesive tape thereon picks up a work piece;

means for raising said lifting device and for transversely transporting said lifting device means to said second deposition point after said work piece has been picked up wherein said winding means and associated roller means remain in said lower position whereby said work piece remains adhered during said transport;

means for lowering said lifting device at said second deposition point and means for raising said winding means and said associated roller means to the upper position at said second deposition point whereby said roller means retract into said aperature and said work piece is released;

wherein the improvement comprises:

said lifting means comprise one horizontally oriented pressure plate selectively movable in the vertical direction wherein said pressure plate has an area defined by a first dimension in a first direction and by a second dimension in a second direction transverse to the first direction;

said adhesive tape pickup means comprises a plurality of independent units with the frame member of each unit defined by a vertically aligned tubular housing; and fastening means for permitting selective movement of each tubular housing in both said first and said second directions of said one pressure plate and for detachably connecting each tubular housing to said pressure plate in a preselected desired arrangement whereby said plurality of independent functional units are arranged on said pressure plate to conform to the selected shape of said workpieces.

2. The apparatus according to claim 1 wherein said fastening means comprises adhesion magnets.

3. In an apparatus according to claim 1 wherein the second deposition point is the feed to a fixing press, the improvement further comprising:

two first deposition points with each first deposition point located at equal distances on opposite sides of said second deposition point with said platform disposed over and bridging said three deposition points;

a carriage movably mounted on said platform for horizontal travel thereon;

two lifting device means mounted on said carriage arranged one behind the other in the direction of travel of said carriage and spaced from one another at a distrance equal to the distance from said each first deposition point to said second deposition point.

4. An apparatus according to claim 1 wherein said first deposition point comprises a magazine open at the top for receiving a stack of planar workpieces;

said magazine comprising a base plate and a lateral boundary defined by a plurality of brush elements with each brush element having bristles oriented laterally and slightly downward; and wherein said base plate comprises a magnetic material and each brush element is mounted on said base plate by adhesion magnets at preselected locations so that said plurality of adhered brush elements define said lateral boundary to conform to the outer contour of said work pieces to be stacked on said magazine.

5. An apparatus according to claim 4 wherein the bristles of said brush elements are highly flexible, have a length of about 20 mm and downward inclination of about 20° with respect to the horizontal.

6. An apparatus according to claim 5 wherein the bristles of said brush elements are pig's bristles and have a thickness of 0.10 to 0.20 mm.

7. An apparatus according to claim 1 wherein said adhesive tape winding means comprises:

a vertical plate member;

a horizontal first axle member mounted to said plate member;

a horizontal second axle member mounted to said plate member below said first axle member and with said roller means rotatably mounted to said plate member below said second axle member;

first and second tape reels rotatably mounted on said first and second axle members repsectively with adhesive tape extending from said second tape reel over said roller means to said first tape reel;

a gear means rotatably mounted on said first axle and fixed to said first tape reel;

ratchet means mounted on the interior of said tubular housing and said gear means having circumferential teeth in engagement therewith for rotation of said gear and said first tape reel upon vertical movement of said adhesive tape winding means in a selected direction.

8. An apparatus as recited in claim 7 wherein:

said tubular housing has movably mounted therein guide means for detachably receiving said adhesive tape winding means, and said tubular housing has mounted thereon a detachable lid for providing access for inserting said adhesive tape winding means onto said guide means.

9. An apparatus as recited in claim 8 further including:

a compressed air cylinder having a piston rod extending from one end thereof disposed in said tubular housing with the opposite end of said compressed air cylinder facing said pressure plate;

wherein said piston rod is connected to said guide means receiving said adhesive tape winding means;

a compressed air distributor mounted on said pressure plate;

means connecting said compressed air distributor in fluid communication with said compressed air cylinder; and means for selectively providing compressed air to said compressed air cylinder thereby causing selective vertical movement of said adhesive tape winding means via connection of said piston rod to said guide means.

10. An apparatus according to claim 9 wherein said compressed air distributor is a distributor strip extending along the length of the pressure plate at the edge of said pressure plate.

11. An apparatus according to claim 1 wherein said adhesive tape pickup means comprises:

a pressure hood detachably connected to and extending downward from said pressure plate;

said tubular housing is held in telescope fashion in said pressure hood for vertical movement therein toward and away from said pressure plate;

a first spring means resiliently forcing said tubular housing away from said pressure plate;

guide means movably mounted in said tubular housing for vertical movement therein with said guide means receiving said tape winding means and said associated roller means for vertical movement therewith;

a first rack means mounted on said pressure hood;

a double gear means rotatably mounted in said tubular housing above said guide means and having a first set of gear teeth continuously on the circumference of a first portion of said double gear means operationally engaging said first rack means for causing rotation of said double gear means upon each movement of said tubular housing in the direction of said pressure plate;

a second set of gear teeth disposed on the circumference of a second portion of said double gear means wherein said second set of gear teeth are arranged on selected intermittent spaced apart sectors of said second portion circumference;

a second spring means resiliently forcing said guide means to said lower position in said tubular housing;

second rack means joined to said guide means and intermittently engaging a sector of said second set of gear teeth; wherein upon every second stroke of said tubular housing toward said pressure plate, said second rack means operationally engages a sector of said second set of gear teeth and rotation of said double gear means by engagement of said first set of gear teeth with said first rack means causes vertical upward movement of said second rack means and thereby causes vertical upward movement of said guide means resulting in vertical movement of said tape winding means against the force of said second spring means to said upper position.

12. An apparatus according to claim 1 wherein said adhesive tape pickup means comprises:

a pressure hood detachably connected to and extending downward from said pressure plate;

said tubular housing is held in telescope fashion in said pressure hood for vertical movement therein toward and away from said pressure plate;

a first spring means resiliently forcing said tubular housing away from said pressure plate;

guide means movably mounted in said tubular housing for vertical movement therein with said guide means receiving said tape winding means and said associated roller means for movement therewith;

a second spring means disposed within said tubular housing resiliently forcing said guide means to said lower position in said tubular housing;

cable pull means connected to said guide means selectively actuated to raise said guide means to said upper position in said tubular housing against the force of said second spring means;

a control wheel rotatably mounted in said tubular housing with said control wheel having a ratchet-like circumferential surface;

a rod member mounted within said pressure hood and extending into engagement with ratchet surface of said control wheel whereby said control wheel is rotated a selected amount upon an upward stroke of said tubular housing toward said pressure plate; and cable pull actuating means connected to said control wheel for actuating said cable pull means for raising said guide means to said upper position upon every successive second upward stroke of said tubular housing toward said pressure plate.

13. An apparatus according to claim 1 wherein said adhesive tape pickup means comprises:

a pressure hood detachably connected to and extending downward from said pressure plate;

said tubular housing is held in telescope fashion in said pressure hood for vertical movement therein toward and away from said pressure plate;

a first spring means resiliently forcing said tubular housing away from said pressure plate;

guide means movably mounted in said tubular housing for vertical movement therein with said guide means receiving tape winding means and said associated roller means for movement therewith;

a second spring means disposed within said tubular housing resiliently forcing said guide means to said lower position in said tubular housing;

detent means for engaging said guide means to hold said guide means in said upper position against the force of said second spring means; and means for releasing said detent means upon a first upward stroke movement of said tubular housing in said pressure hood whereby said second spring means forces said guide means to said lower position and for causing said detent means to engage said guide means in the next succeeding upward stroke of said tubular housing in said pressure hood.

* * * * *